United States Patent [19]

Schminke et al.

[11] 4,058,377

[45] Nov. 15, 1977

[54] DUST COLLECTING ELECTROSTATIC PRECIPITATOR

[75] Inventors: Heinz Schminke, Egelsbach; Kurt Rau, Frankfurt am Main; Willi Bätza, Offenbach, all of Germany

[73] Assignee: Metallgesellschaft Aktiengesellschaft, Frankfurt am Main, Germany

[21] Appl. No.: 711,314

[22] Filed: Aug. 3, 1976

[30] Foreign Application Priority Data

Aug. 12, 1975 Germany ..... 2535830

[51] Int. Cl.[2] ..... B03C 3/04

[52] U.S. Cl. ..... 55/148; 55/156

[58] Field of Search ..... 55/112, 145, 148, 156, 55/141

[56] References Cited

U.S. PATENT DOCUMENTS

| | | | |
|---|---|---|---|
| 2,123,464 | 7/1938 | Engelman | 55/112 |
| 3,803,809 | 4/1974 | Gelhar et al. | 55/156 |

*Primary Examiner*—Bernard Nozick
*Attorney, Agent, or Firm*—Karl F. Ross

[57] ABSTRACT

A dust-collecting electrostatic precipitator in which the collecting plates are constituted from interlocked thin sheet-metal strips with loosely interengaging edges and are suspended at the top from a common carrier, in which stabilization is increased against vibration by providing the lateral edges of the plates with short retaining members in a single horizontal zone or in a plurality of such zones spaced apart vertically from one another. The retaining members are interconnected by a rigid element. The system is particularly suited for tall electrostatic precipitators having a height of, say, 15 meters in which high gas velocities would otherwise cause extensive vibration of the electrode strips.

2 Claims, 4 Drawing Figures

DUST COLLECTING ELECTROSTATIC PRECIPITATOR

FIELD OF THE INVENTION

The present invention relates to dust-collecting electrode structures for electrostatic precipitators and, more particularly, electrostatic precipitators operating with high gas velocity and having tall dust-collecting electrodes.

BACKGROUND OF THE INVENTION

An electrostatic precipitator generally comprises a housing structure having a gas inlet and a gas outlet and, between the gas inlet and gas outlet, a stack of mutually parallel but spaced-apart collector electrodes which are generally planar and disposed with a vertical orientation. Beneath this stack there may be provided a bin into which the collected particles pass when the electrodes are jolted by a rapping device. Between the dust-collecting electrodes, corona discharge wires may be provided in parallel arrays to charge the dust particles so as to enable them to be attracted to the collecting electrodes.

In recent years, as the demand for electrostatic precipitators has developed with increasing concern for environmental pollution, particular collector electrode arrangements have gained prominence.

In the commonly assigned U.S. Pat. No. 3,803,809 issued Apr. 16, 1974, for example, there is described by one of us, among others, an advanced construction of the collecting electrode assembly in which each of the collecting electrode walls consist of a multiplicity of individual metal strips, the contiguous portions of adjacent strips having loosely interengaging edges. The strips forming each of the plates are suspended from their tops from a common carrier or beam and are secured at their bottoms to a common bar upon which acts the rapping linkage.

The outer edges of each plate, i.e. the free edges of the two strips lying along the vertical edges of the plate, are held against rotation by claw-like profiled members which embrace these edges. As disclosed in the aforementioned patent, these profile edge members prevent rotation of the electrode walls and extend substantially the entire height of the strips which they engage.

It was pointed out in said patent, moreover, that difficulties arise in the removal of dust from exhaust gases when pyrophoric fine dust collectors on the electrode and flameless combustion takes place in local areas of the collecting electrodes.

These localized excess heating tends to relax internal stresses which are present in the collecting-electrode strips as a result of their formation by cold-rolling. The electrode strips, which are narrow and high, thus tend to be distorted and twisted so that the width of the discharge gap between them and the array of corona-discharge or ionizing electrodes is decreased and increased at various locations. Any decrease in the gap means that a lower operating voltage must be used especially where the operating voltage is close to the breakdown voltage which would result in a continuous arc between the collecting electrode strip and the ionizing electrode. As the gap width decreases, therefore, the effective operating voltage and certainly the maximum possible operaint voltage decreases.

As the voltage level is reduced, there is a corresponding reduction in the effectiveness of particle removal from the gas and the degree from which particles are removed.

It is for this reason that the system of the aforedescribed patent provides distortion-limiting channels over the entire height of the electrode strips at the edges of each plate. These twist-resisting channels are forceably moved into positions in which they embrace the exposed outer edges of the collecting electrodes, thereby retaining them against rotation.

As a consequence, the electrodes cannot be distorted to any significant degree and cannot twist to a detrimental extent.

With increases in the size of industrial operation, e.g. larger cement mills, sintering plants, power plants and the like, there has been a corresponding need for larger dust-collecting electrostatic precipitators as noted above.

The most effective way of increasing the size of an electrostatic precipitator for a given area to be occupied is by increasing its height so that the electric field and hence collecting electrode plate heights of 15 meters and more are not uncommon. When high gas velocities are employed with such plates, even with the techniques described in the aforementioned patent, problems have been found to arise.

For example, at gas velocities in excess of two meters per second, vibration is excited in the long electrode strips so that the distance between the collecting electrodes and the array of corona-discharge electrodes is periodically or aperiodically varied with the same detrimental effect as if the strips were distorted. This phenomenon is analogous, therefore, to the phenomenon resulting from flameless combustion and equally limits the maximum operating voltage and hence the maximum degree of particle separation from the gas.

OBJECTS OF THE INVENTION

It is the principal object of the present invention to provide an improved electrostatic precipitator in which the afore-described disadvantages are obviated.

Another object of the invention is to provide a system which is improved over that of U.S. Pat. No. 3,803,809 in the sense that it is less sensitive to vibration at high gas velocities.

Another object of the invention is to provide an improved collecting electrode structure, particularly for very high electrostatic precipitators.

SUMMARY OF THE INVENTION

We have now found that the aforedescribed problem can be solved in a tall electrostatic precipitator having laterally interconnected electrode strips forming the respective collecting electrode plates, if at least one row of relatively short channel-like retaining members is provided at a given level along at least one of the sides of the stack, the members being interconnected by a linkage which extends across the width of this stack.

Several horizontal rows of such sectional members may be provided, the rows being disposed in the vertically spaced relationship and preferably such rows of retaining members are formed on both sides of the stack in a single horizontal row or a plurality of vertically spaced rows. Each row has a respective linkage.

For reasons which are not fully understood, this system appears to obviate the vibrations which have posed a problem even in the system of the aforedescribed patent and presumably resulting from the establishment of vibration waves in the elongated edge retainers which run the full height of the plate in that patent.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
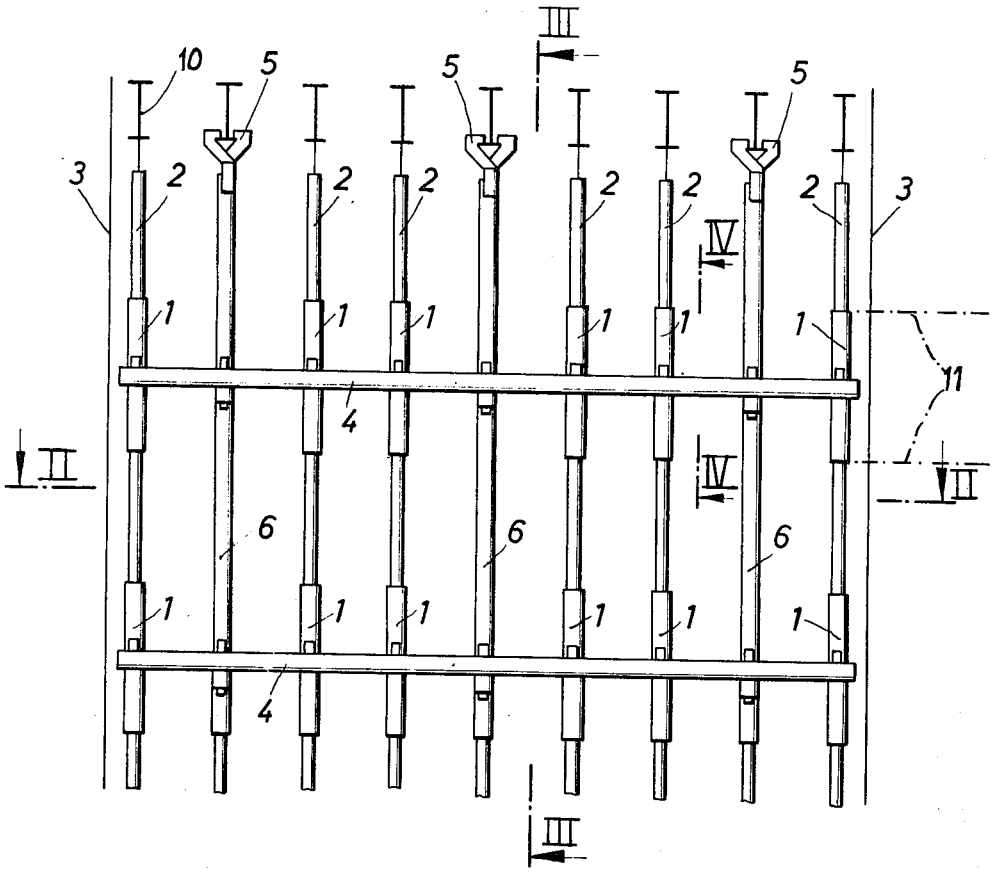
FIG. 1 is a simplified diagrammatic vertical section of a stack of collector plates in accordance with the present invention.
Figure 2:
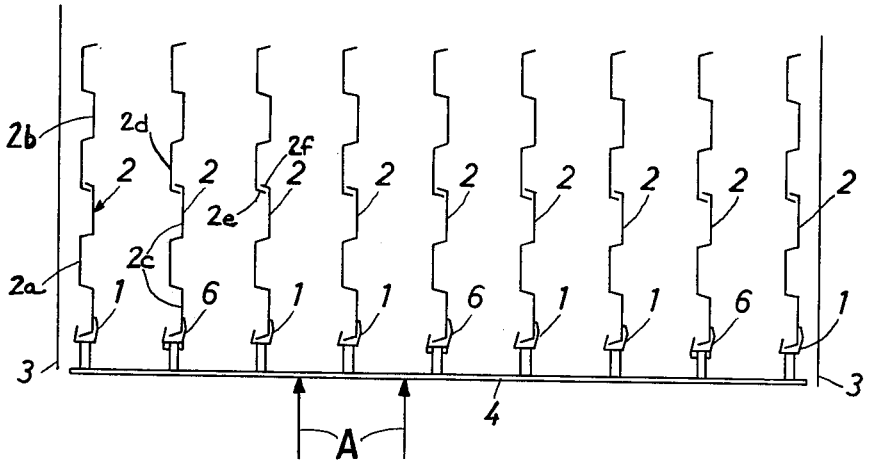
FIG. 2 is a fragmentary section taken along the line II—II of FIG. 1.

In FIG. 1, the walls 3 represent the lateral boundaries of the gas flow path in the dust collector, the gas being passed in the direction of the arrows A, parallel to the collecting electrode walls and transversely to the longitudinal directions of the strips constituting the same. The planes 3 may represent the lateral walls of a housing structure whose top, bottom and inlet-side and outlet-side walls have not been illustrated. The top of the flow path is essentially defined by the structure from which the collecting electrode walls 2 are suspended. This structure can consist of I-beams 10 from which the plate assemblies are suspended.

Each of the plates 2 may comprise a plurality of contoured sheet-metal strips 2*a*, 2*b* . . . with alternating crests 2*c* and troughs 2*d*, the contiguous edges 2*e* and 2*f* of adjoining strips being interlocked loosely as described in U.S. Pat. No. 3,803,809. The metal strips of each row are connected at their bottoms to a common rapping linkage not shown in the drawing but corresponding, for example, to member 5 of the aforementioned patent.

In this dust collector, moreover, short chlor-like profiled retaining members 1 are provided in a horizontal row represented at 11, the retaining members being interconnected by a linkage such as a bar 4. The bar 4 may have inwardly turned legs 4*a* which are welded at 4*b* to the members 1. A single such assembly may be provided or such assemblies may be vertically spaced along each side of the stack of plates as shown for one side in FIG. 1.

The bars 1 have brackets 4*c* with downwardly turned legs 4*d* resting in hasps 6*a* of continuous sectional retaining members 6 which can be of the type described in said patent, except that they are suspended by hooks 5 from the respective I-beams from which their electrode plates are likewise suspended. The sectional members 6 have the same cross-sectional configuration as the retaining members 1. Thus, the longer member 6 which can extend substantially the full height of the stack, serves to suspend the linkage bars 4 on which, in turn, the short sectional members 1 are mounted.

Figure 3:
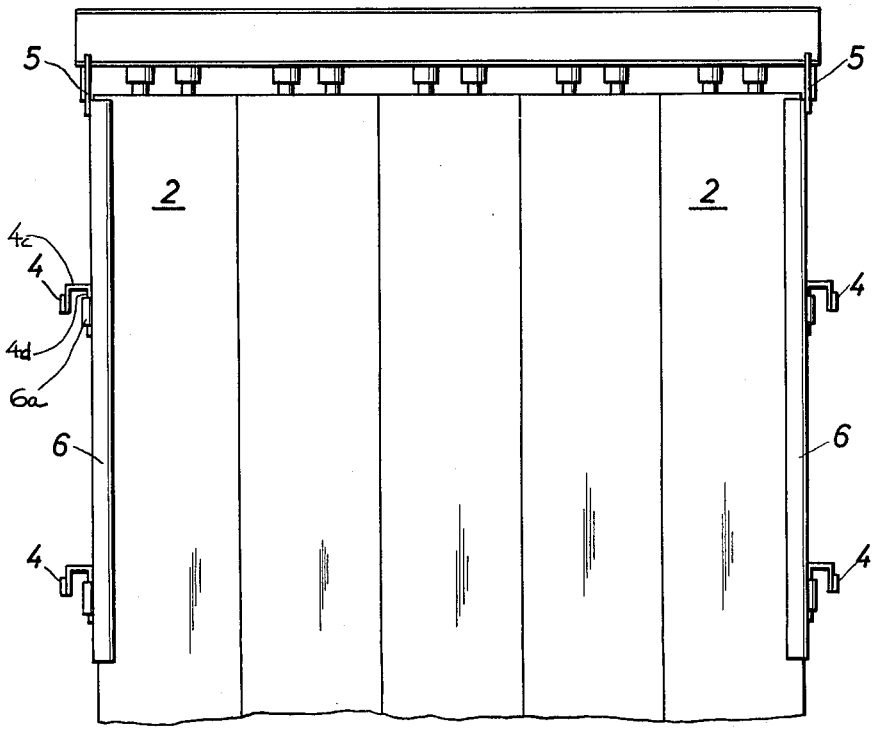
FIG. 3 is a fragmentary section taken along the line III—III of FIG. 1.
Figure 4:
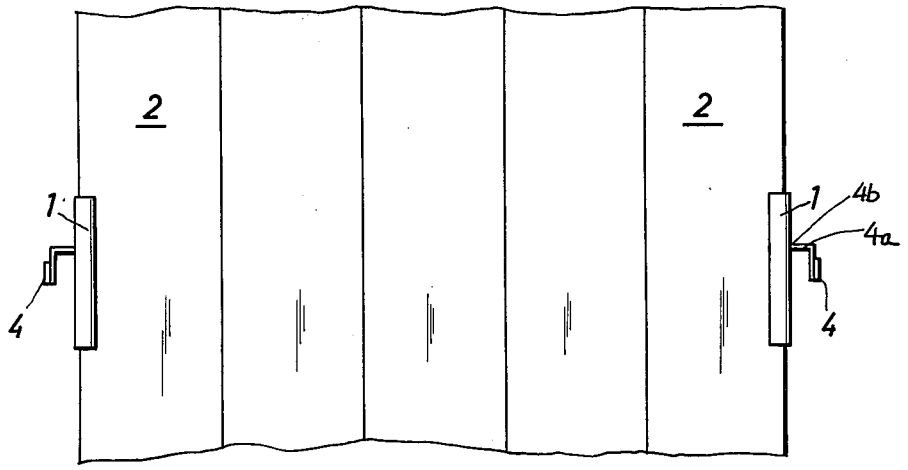
FIG. 4 is a sectional view taken along the line IV—IV of FIG. 1.

Other connections than the U-shaped brackets 4*c* and the pockets 6*a* may be used to carry the short members 1. The latter have a length which is a small fraction of the total height of the electrode plate, e.g. one quarter or less of this height, and have a similar relationship to the length of the central members 6. The members 1 and 6 may have claw-like cross-sections corresponding to FIGS. 3 and 3A of said patent to envelop the outer edges of the outermost strips 2*a*.

The system has, surprisingly, be found to be free from exaltation at high gas velocities even when compared with systems in which retaining members are provided the full height of the stack. The members 6 can be provided on alternate electrode plates, after every second short sectional member 1 or with even a greater spacing.

We claim:

1. A collecting-electrode assembly for an electrostatic precipitator comprising;

a support structure;

a multiplicity of mutually parallel transversely spaced vertical collecting electrodes each comprising a plurality of vertically extending sheet-metal strips loosely engaging at lateral edges an adjoining strip, the outermost strips of each collecting electrode having vertical outer edges at the sides of said assembly;

means for suspending each of said strips from said support structure;

at least one horizontal row of short sectional members each respectively engaging the outer edges of some of said collecting electrodes along one side of said assembly, said sectional members extending vertically and being of a length which is a minor fraction of the length of the outer edge engaged thereby;

a horizontally extending rigid bar fixed rigidly to all of said member of said row;

long sectional members embracing the outer edges of others of said collecting electrodes along said one side of said assembly, said long sectional members extending over a length substantially greater than the length of said short sectional members;

means for suspending said long sectional members from said support structure; and means for suspension of said bar from said long sectional members, said sectional members fitting around the outer edges of the respective collecting electrodes.

2. The assembly defined in claim 1 wherein two such rows of short sectional members are provided on said one side of the assembly and are rigidly connected to a further rigid bar, said assembly further comprising further means for suspending said further rigid bar from said long sectional members.

* * * * *